US006863624B1

(12) United States Patent
Kessler

(10) Patent No.: US 6,863,624 B1
(45) Date of Patent: Mar. 8, 2005

(54) GOLF CLUB

(75) Inventor: Peter S. Kessler, Orlando, FL (US)

(73) Assignee: Perfect Club Company, Orlando, FL (US)

( * ) Notice: Subject to any disclaimer, the term of this patent is extended or adjusted under 35 U.S.C. 154(b) by 0 days.

(21) Appl. No.: 10/321,747

(22) Filed: Dec. 17, 2002

(51) Int. Cl.[7] ..... A63B 53/04
(52) U.S. Cl. ..... 473/328
(58) Field of Search ..... 473/324, 327, 473/328, 342, 345, 349, 350

(56) References Cited

U.S. PATENT DOCUMENTS

| | | | | |
|---|---|---|---|---|
| 1,774,590 | A | * 9/1930 | Buhrke | 473/328 |
| 1,868,286 | A | * 7/1932 | Grieve | 473/328 |
| 1,916,792 | A | 7/1933 | Hadden | |
| D94,549 | S | 2/1935 | Jansky | |
| D94,550 | S | 2/1935 | Jansky | |
| 2,041,676 | A | * 5/1936 | Gallagher | 473/328 |
| 3,761,095 | A | 9/1973 | Thompson | |
| 3,830,503 | A | 8/1974 | Consoli | |
| 3,997,170 | A | 12/1976 | Goldberg | |
| 4,065,133 | A | 12/1977 | Gordos | |
| 4,313,607 | A | 2/1982 | Thompson | |
| 4,319,752 | A | 3/1982 | Thompson | |
| 4,756,534 | A | 7/1988 | Thompson | |
| D307,783 | S | 5/1990 | Iinuma | |
| D310,254 | S | 8/1990 | Take et al. | |
| D318,087 | S | 7/1991 | Helmstetter | |
| 5,042,806 | A | 8/1991 | Helmstetter | |
| 5,163,682 | A | 11/1992 | Schmidt et al. | |
| 5,240,252 | A | 8/1993 | Schmidt et al. | |
| 5,271,622 | A | 12/1993 | Rogerson | |
| D343,434 | S | 1/1994 | Helmstetter et al. | |
| D344,117 | S | 2/1994 | Helmstetter et al. | |
| D345,403 | S | 3/1994 | Sanchez | |
| 5,301,944 | A | 4/1994 | Koehler | |
| 5,301,945 | A | 4/1994 | Schmidt et al. | |
| 5,318,300 | A | 6/1994 | Schmidt et al. | |
| D354,103 | S | 1/1995 | Allen | |
| D356,843 | S | 3/1995 | Schmidt et al. | |
| D357,290 | S | 4/1995 | Viollaz et al. | |
| 5,441,263 | A | 8/1995 | Gorman | |
| 5,452,890 | A | 9/1995 | Bingman | |
| 5,460,376 | A | 10/1995 | Schmidt et al. | |
| 5,465,970 | A | 11/1995 | Adams et al. | |
| 5,470,069 | A | 11/1995 | Schmidt et al. | |
| D364,906 | S | 12/1995 | Schmidt et al. | |
| D365,129 | S | 12/1995 | Guibaud et al. | |
| 5,474,296 | A | 12/1995 | Schmidt et al. | |
| 5,480,152 | A | 1/1996 | Schmidt et al. | |
| 5,484,155 | A | 1/1996 | Yamawaki et al. | |
| D370,952 | S | 6/1996 | Ramirez et al. | |
| 5,547,188 | A | 8/1996 | Dumontier et al. | |
| D377,674 | S | 1/1997 | Schmidt et al. | |
| 5,611,741 | A | 3/1997 | Schmidt et al. | |
| D385,607 | S | 10/1997 | Adams | |
| 5,692,970 | A | * 12/1997 | Nelson | 473/318 |
| 5,697,853 | A | 12/1997 | Schmidt et al. | |
| D389,542 | S | 1/1998 | Rollinson et al. | |
| D392,007 | S | 3/1998 | Fox | |
| 5,755,624 | A | 5/1998 | Helmstetter | |

(List continued on next page.)

FOREIGN PATENT DOCUMENTS

| | | |
|---|---|---|
| EP | 0 517 487 A1 | 9/1992 |
| WO | WO 01/00284 A1 | 1/2001 |

*Primary Examiner*—Raleigh W. Chiu
(74) *Attorney, Agent, or Firm*—Jones Day

(57) ABSTRACT

The present invention relates to a metal wood golf club and golf club head, in which the golf club head includes a flat triangular torsion stabilizing surface raised from the sole, wherein the base of the flat triangular shaped torsion stabilizing surface is located toward the back of the sole and the vertex is located toward the front of the sole. Additional features are combined with the torsion stabilizing surface to provide a golf club having truer performance.

28 Claims, 3 Drawing Sheets

U.S. PATENT DOCUMENTS 5,762,566 A 6/1998 King et al.
5,762,567 A * 6/1998 Antonious ..... 473/345
D396,513 S 7/1998 Rollinson et al.
5,779,565 A 7/1998 Adams
5,785,605 A 7/1998 Helmstetter
5,797,807 A 8/1998 Moore
5,800,281 A 9/1998 Gilbert
5,931,745 A 8/1999 Adams
5,935,016 A * 8/1999 Antonious ..... 473/305
D415,808 S 10/1999 Helmstetter et al.
6,027,416 A 2/2000 Schmidt et al.
D422,659 S 4/2000 Mertens
D425,159 S 5/2000 Helmstetter et al.
D430,247 S 8/2000 Kruse
D433,073 S 10/2000 Sodano
D437,904 S 2/2001 Galloway et al.
D442,244 S 5/2001 Olsavsky et al.
6,251,029 B1 * 6/2001 Roberts ..... 473/328
D446,567 S 8/2001 Nagai et al.
D453,203 S 1/2002 Madore et al.
D457,930 S 5/2002 Soracco et al.
6,413,168 B1 * 7/2002 McKendry et al. ..... 473/239
6,416,422 B1 7/2002 Nagai et al.
D461,862 S 8/2002 Madore et al.
D464,388 S 10/2002 Imamoto
D465,251 S 11/2002 Wood et al.
6,623,374 B1 * 9/2003 Helmstetter et al. ..... 473/291
6,663,503 B1 * 12/2003 Kenmi ..... 473/328
2002/0016214 A1 2/2002 Hueber
2002/0042305 A1 4/2002 Otoguro
2002/0094882 A1 7/2002 Nagai et al.
2002/0198062 A1 * 12/2002 McCabe et al. ..... 473/290
2003/0087710 A1 * 5/2003 Sheets et al. ..... 473/344

* cited by examiner

GOLF CLUB

FIELD OF THE INVENTION

This invention relates generally to a golf club. In particular this invention relates to a metal wood type golf club having a torsion stabilizing surface on the sole of the golf club head.

BACKGROUND

Wood type golf clubs are used for hitting the ball off the tee, from the fairway, or possibly from the rough or a hazard. The type of golf club chosen by a golfer for a particular shot depends on the shot desired and the condition of the ball's lie. For example, a driver is generally used for tee shots and fairway woods are generally used for hitting the ball from the fairway or rough. A tee shot generally involves hitting the ball from an elevated position and fairway and rough shots involve hitting the ball from the ground. The various functional aspects of the soles of these clubs can be optimized to minimize any deleterious conditions the club head may experience during the swing.

The faster a club head is moving when it comes in contact with the ball, the farther the ball will travel. Any contact with the ground during a swing prior to contact with the ball slows down the speed of the club head and decreases the distance the ball will travel. Further, when a club head strikes an imperfect surface, i.e., the ground, the trajectory of the club head can be altered with deleterious effect on the resultant trajectory of the ball. When striking a ball from an elevated tee, a golfer is generally able to prevent the club head from hitting the ground. However, when striking a ball positioned on the ground, the club head will often strike the ground during the swing. Thus, it is preferred that a club head be optimized for both aerodynamics and to minimize frictional losses to club head speed and alterations to the club head's trajectory caused by ground contact. By maximizing club head speed and minimizing alterations to the club head's trajectory, a true shot may be hit that will travel farther and straighter than otherwise possible.

The deleterious effect that making contact with the ground has on a golf shot often causes golfers to have low confidence as they approach a ball with an imperfect lie. Hitting a ball "fat" or "duffing," as mentioned above, results in a short and potentially errant shot. The fear of "duffing" often causes golfers to unconsciously pull up during their swing resulting in a "topped" shot, which occurs when only the top portion of the ball is struck. As neither topping nor duffing is desirable, a golf club that minimizes the effects of a duffed shot would enable a golfer to approach a ball with confidence thereby preventing topped shots.

SUMMARY OF THE INVENTION

The claimed invention relates to a golf club comprising a head, a shaft, and a grip. The head of the metal wood type golf club comprises a face, a sole, a back, and a hosel. A flat triangular torsion stabilizing surface is raised from the surface of the sole. The base of the triangular torsion stabilizing surface is located toward the back and the vertex of the triangular torsion stabilizing surface is blunted and is located at about the center of the sole toward the face. The leading edge of the sole is angled down and away from the face. The loft angle of the face is about 21 degrees. The weight of the head is distributed disproportionately toward the sole. The hosel is offset. The shaft of the metal wood type golf club is shorter than a conventional fairway wood.

Another aspect of the present invention relates to a golf club head comprising a face, a sole, a back, and a hosel. A flat triangular torsion stabilizing surface is raised from the surface of the sole. The base of the triangular shaped torsion stabilizing surface is located toward the back and the vertex of the triangular torsion stabilizing surface is located toward the face.

The golf club head can be a wood type golf club head. The front of the triangular torsion stabilizing surface can be blunted. The vertex of the flat, torsion stabilizing surface can be located at about the center of the sole toward the face. The leading edge of the sole can be angled down and away from the face. The loft angle of the face can be between 18 and 24 degrees. The weight of the club head can be distributed disproportionately toward the sole. The hosel of the club head can be offset. A shaft can be connected to the golf club head. The shaft connected to the golf club head can be shorter than a conventional fairway wood. The shaft can be between 36 and 41 inches long. The diameter of the shaft can be between 0.340 and 0.365 inches at the hosel. The torsion stabilizing surface can be raised a substantially equal amount above the sole around its periphery.

BRIEF DESCRIPTION OF THE DRAWINGS FIGURES

DETAILED DESCRIPTION

Figure 1:
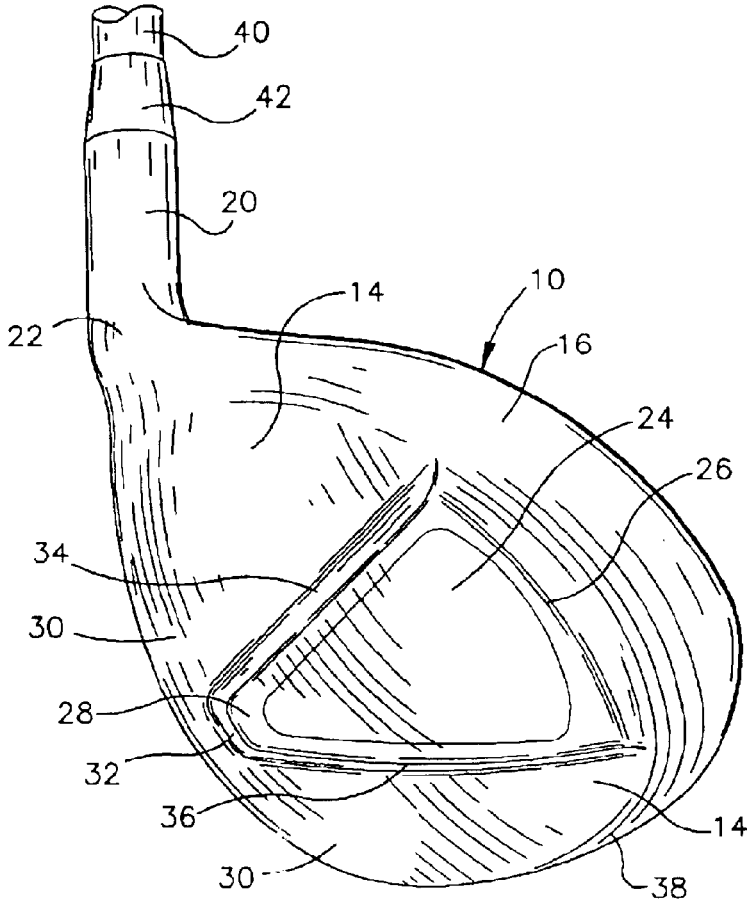
FIG. 1 is a perspective view of a golf club head according to the present invention.
Figure 2:
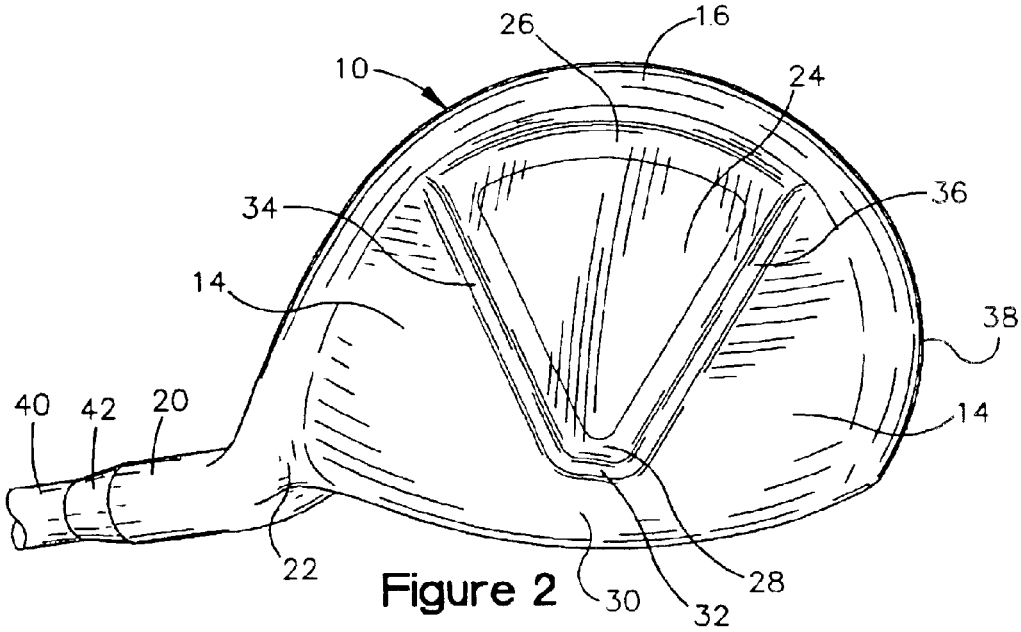
FIG. 2 is a bottom plan view of a golf club head according to the present invention.
Figure 3:
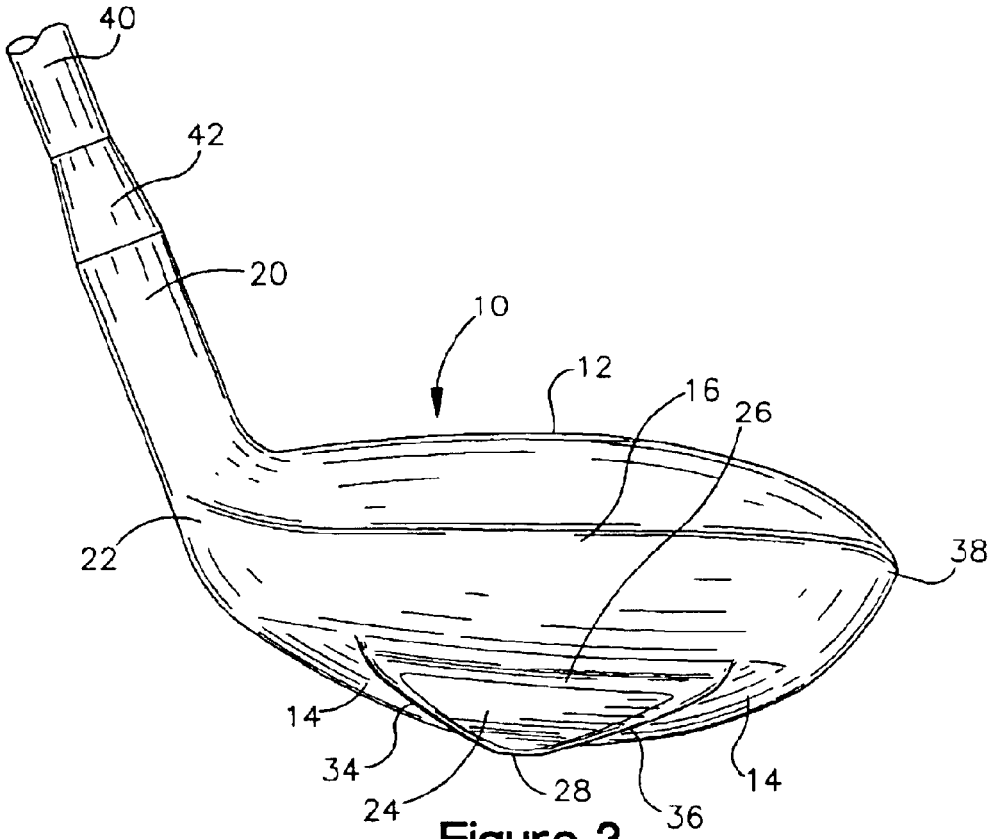
FIG. 3 is a rear view of a golf club head according to the present invention.
Figure 4:
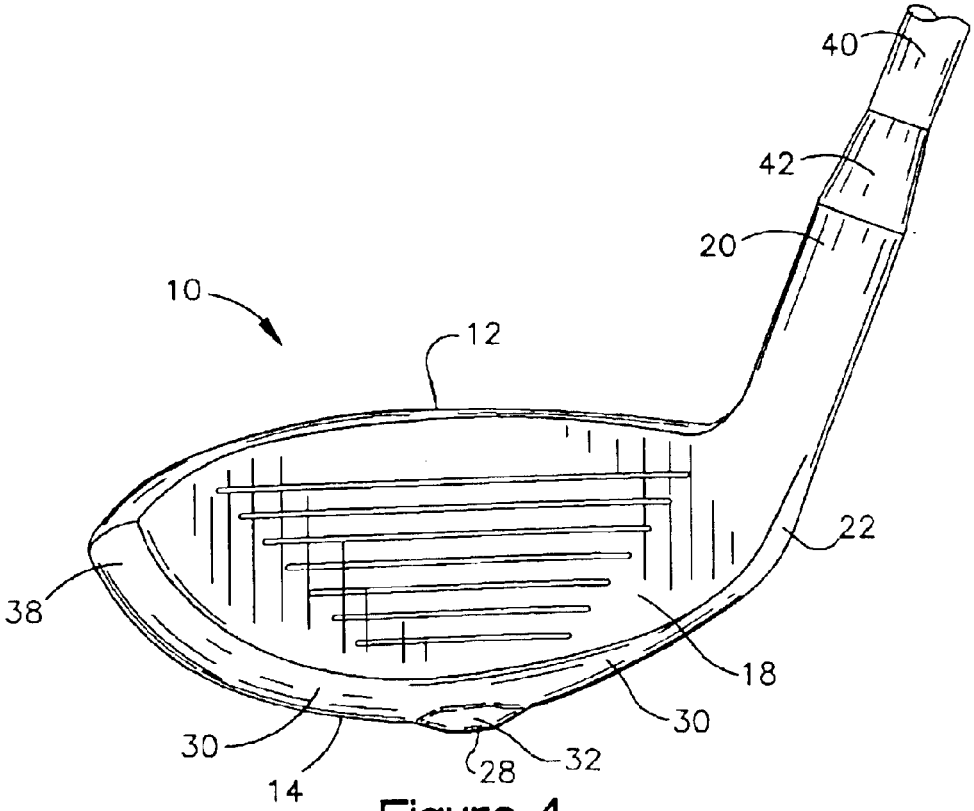
FIG. 4 is a front view of a golf club head according to the present invention.

Referring now to the drawings, the invention will be described in more detail.

FIGS. 1–6 illustrate one embodiment of a golf club head 10 in accordance with the present invention. The club head 10 comprises a top portion 12, a sole portion 14, a back portion 16, a ball striking face 18, and a shaft receiving portion or hosel 20 extending generally from the top portion 12 of the club head 10 at the heel 22. The torsion stabilizing surface 24 is attached to the sole portion 14. The torsion stabilizing surface 24 is integrally molded within the sole portion 14 forming a unitary piece.

The torsion stabilizing surface 24 is elevated from the surface of the sole portion 14 of the club head 10. The torsion stabilizing surface 24 is flat, i.e., it is relatively smooth and even without any peaks or depressions. A logo may be lightly engraved or otherwise placed on the raised flat portion of the torsion stabilizing surface 24, if so desired. The torsion stabilizing surface 24 adopts the curvature of the sole portion 14 and the surface of the torsion stabilizing surface 24 remains generally parallel to and equidistant from the surface of the sole portion 14. The base 26 of the triangle forming the torsion stabilizing surface 24 merges with the back portion 16 of the club head 10. The vertex 28 of the triangle forming the torsion stabilizing surface 24 is positioned to ward the center of the front of the sole portion 14 behind the ball striking face 18.

Figure 5:
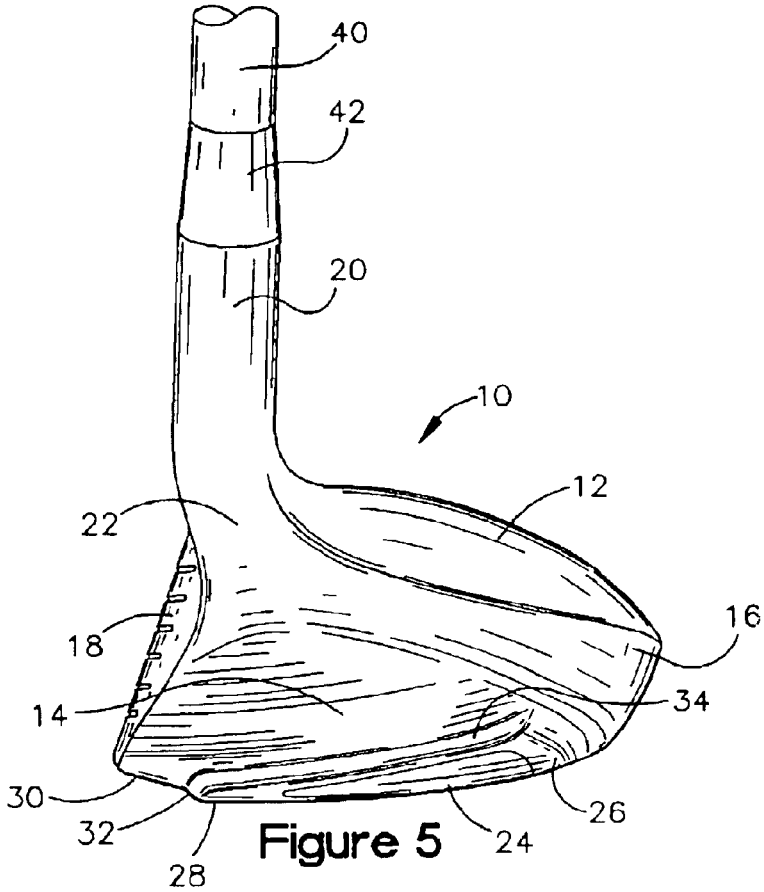
FIG. 5 is a view from the heel of a golf club head according to the present invention.
Figure 6:
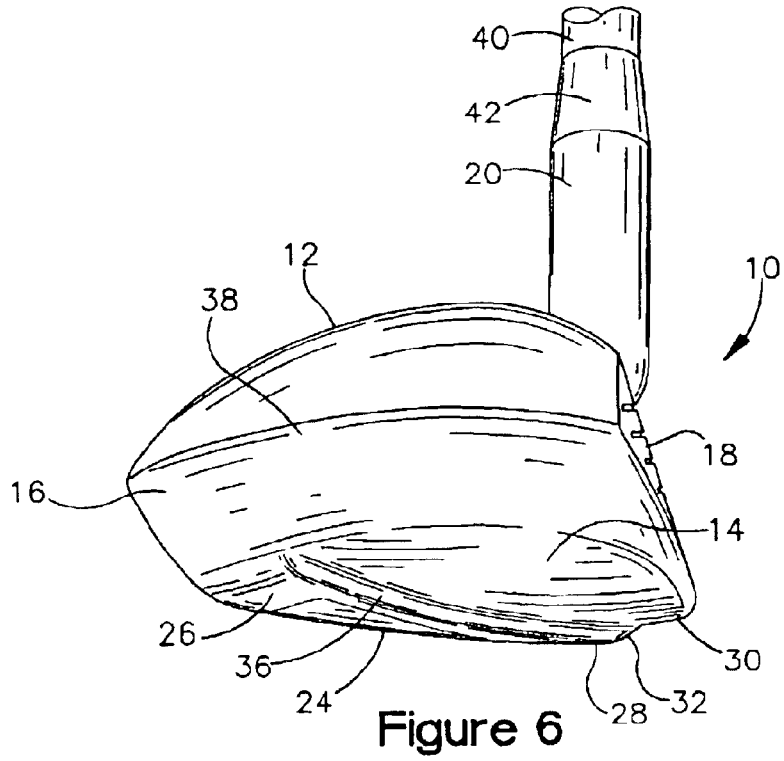
FIG. 6 is a view from the toe of a golf club head according to the present invention.

The angled front section 30 of the sole portion 14 is angled forwardly and upwardly as depicted in FIGS. 5–6 from a point toward the front of the sole portion 14 until the sole portion 14 merges at a common boundary with the ball striking portion 18. By being angled forwardly and upwardly, the angled front section 30 of the sole portion 14 acts to lift the club head 10 off the ground once contact is made between the ground and the sole portion 14 during a golfer's swing, thereby, minimizing frictional contact between the club head 10 and the ground. The ground as thereby, minimizing frictional contact between the surfaces encountered while playing golf such as, for example, turf, grass, sand, leaves, or pine needles, among other surfaces.

The vertex 28 of the triangle forming the torsion stabilizing surface 24 is blunted and forms a forward edge 32 of the torsion stabilizing surface 24 that slopes away from the torsion stabilizing surface 24 toward the ball striking portion 18 to merge with the angled front section 30 of the sole portion 14. The blunted forward edge 32 of the raised triangular shaped torsion stabilizing surface 24 can be angled more shallowly than the heel edge 34 and toe edge 36 of the torsion stabilizing surface 24 to efficiently merge with the angled front section 30 of the sole 14. The heel edge 34 and the toe edge 36 of the torsion stabilizing surface 24 slope away from the raised, flat surface of the torsion stabilizing surface 24 and merge with the sole portion 14 toward the heel 22 and toe 38 of the club head respectively. The heel edge 34 and toe edge 36 of the torsion stabilizing surface 24 stabilize the club head 10 trajectory as the club head 10 contacts the ground during a swing by providing equal and opposite, i.e., balancing, forces. The equal forces acting on either side of the torsion stabilizing surface 24 counteract each other leaving a trajectory that is consistent with the trajectory before the sole made contact with the ground.

Additional features of the club head 10 of this embodiment of the present invention include a unique loft angle, a disproportionate weight distribution, and an offset hosel 20. The loft angle of the club head 10 of this embodiment of the present invention is 21 degrees whereas the loft angle of a conventional seven wood is 20 degrees and the loft angle of a conventional five wood is 17–18 degrees. The increased loft angle of the club head 10 of this embodiment of the present invention over conventional five and seven woods produces greater height for a given golf shot as compared to a conventional five or seven wood. The loft angles of additional embodiments of the club head 10 of the present invention can be between about 18 and 24 degrees, preferably between about 19 and 23 degrees, and more preferably between about 20 and 22 degrees. The weight of the club head 10 of this embodiment of the present invention is disproportionately distributed toward the sole portion 14 in order to lower the center of gravity. A lower center of gravity of the club head 10 of this embodiment of the present invention positions the weight of the club head closer to where the ball is normally struck on the ball striking face 18 from a position on the ground. The hosel 20 of the club head 10 of this embodiment of the present invention is offset forward of the ball striking face 18. Offsetting the hosel 20 in this manner minimizes pushing or slicing, as known by those of skill in the art.

A second embodiment of the present invention is a men's golf club utilizing a golf club head with a raised torsion stabilizing surface on its sole. In addition to the golf club head 10, as discussed above, the golf club comprises a grip and a shaft 40 (not shown). The grip can be any type of grip that is commercially or otherwise available. The shaft 40 of the men's golf club of this embodiment of the present invention is about 39 inches long. The shaft lengths of additional embodiments of the present invention can be between about 37 and 41 inches long, and preferably between about 38 and 40 inches long. The shaft of an average men's seven wood is 41.5–42 inches long. The shorter 39 inch shaft 40 of the present embodiment allows the golfer to position himself closer to the ball during setup. Being closer to the ball during set up allows the golfer to adopt an athletic stance providing greater confidence and a more controlled swing. Greater confidence, a more athletic stance, and a more controlled swing reduce the potential that a golfer will top the ball. The lie angle of the golf club head 10 is set relative to the shaft length to allow the golf club head 10 to properly address the ball.

An additional feature of the shaft 40 of this embodiment of the present invention is the diameter of the shaft 40 at the point where the shaft 40 enters the hosel 20. When a club head strikes a ball, or the ground, the end of the club head opposite the end of the club head attached to the shaft, i.e., the toe, tends to twist, or torque, away from the end of the club head attached to the shaft, i.e., the heel. As any change in the orientation of a club head during the golfer's swing will cause deleterious effects in the resultant golf shot, minimizing torque when a club head contacts the ball or the ground will increase a club's ability to hit true shots. This torquing action tends to occur partially within the shaft 40 itself and partially at the golfer's hold on the club grip. Because the twisting occurs partially within the shaft 40 a golfer cannot alleviate all torquing action by gripping the club more firmly. A conventional iron type club has a shaft diameter at the hosel of 0.375 inches and the shaft diameter at the hosel of a conventional wood type club is 0.330 inches. The greater shaft diameter of a conventional iron as compared to a conventional wood reduces torque within the shaft. The diameter of the shaft 40 of this embodiment of the present invention at the hosel 20 is about 0.350 inches. By increasing the diameter of the shaft 40 at the hosel 20 of this embodiment of the present invention, torque within the shaft 40 is minimized as compared to a conventional wood type club. The diameters of the shafts 40 of additional embodiments of the present invention at the hosel 20 can be between about 0.340 and 0.365 inches, and preferably between about 0.345 and 0.355 inches. The increased shaft diameter at the hosel 20 of the present invention, as compared to a conventional wood type club, reduces torque thereby increasing the ability of the club of the present embodiment to hit a true shot.

A third embodiment of the present invention is a ladies' golf club utilizing a golf club head with a raised torsion stabilizing surface on its sole. In addition to the golf club head 10, as described above, the ladies' golf club embodiment of the present invention comprises a grip and a shaft 40 (not shown). The grip can be any type of grip that is commercially or otherwise available. The shaft 40 of the ladies' golf club of this embodiment of the present invention is about 38 inches long. The shaft lengths of additional embodiments of the present invention can be between about 36 and 40 inches long, and preferably between about 37 and 39 inches long. The shaft of an average ladies' seven wood is 40.5–41 inches long. The shorter 38 inch shaft 40 of the present embodiment allows the golfer to position herself closer to the ball during setup. Being closer to the ball during set up allows the golfer to adopt an athletic stance providing greater confidence and a more controlled swing. Greater confidence, a more athletic stance, and a more controlled swing reduce the potential that a golfer will top the ball. The lie angle of the golf club head 10 is set relative to the shaft 40 length to allow the golf club head 10 to properly address the ball.

Similar to the men's golf club embodiment of the present invention, an additional feature of the shaft 40 of this embodiment of the present invention is the diameter of the shaft 40 at the point where the shaft 40 enters the hosel 20. The torquing problem in the shaft of a ladies club is the same as that explained with respect to the men's club embodiment. The diameter of the shaft 40 of this embodiment of the present invention at the hosel is 0.350 inches. The diameters of the shafts 40 of additional embodiments of the present invention at the hosel can be between about 0.340 and 0.365 inches, and preferably between about 0.345 and 0.355 inches.

While various features of the claimed invention are presented above, it should be understood that the features may be used singly or in any combination thereof Therefore, the claimed invention is not to be limited to only the specific embodiments depicted herein.

Further, it should be understood that variations and modifications may occur to those skilled in the art to which the claimed invention pertains. The embodiments described herein are examples of the claimed invention. The disclosure may enable those skilled in the art to make and use embodiments having alternative elements that likewise correspond to the elements of the invention recited in the claims. The intended scope of the invention may thus include other embodiments that do not differ that insubstantially differ from the literal language of the claims. The scope of the present invention is accordingly defined as set forth in the appended claims.

Additionally, while this invention has been discussed mainly in the context of a wood type golf club and club head, this invention is not limited to use on wood type golf clubs and may be used on any wood type golf club or iron type golf club.

What is claimed is:

1. A metal wood type golf club comprising:

a head comprising a face, a sole, a back, and a hosel, wherein a flat triangular torsion stabilizing surface is raised from the surface of said sole such that each of the three sides of said triangular torsion stabilizing surface is raised, the base of said triangular torsion stabilizing surface is located toward the back and the vertex of said triangular torsion stabilizing surface is blunted and is located at about the center of said sole toward the face, the leading edge of said sole is angled down and away from said face, the loft angle of said face is about 21 degrees, the weight of said head is distributed disproportionately toward said sole, and said hosel is offset;

a shaft, wherein said shaft is shorter than a conventional fairway wood; and a grip.

2. The metal wood type golf club of claim 1 wherein said shaft is about 38 inches long.

3. The metal wood type golf club of claim 1 wherein said shaft is about 39 inches long.

4. The metal wood type golf club of claim 1 wherein said shaft has a diameter of about 0.350 inches at said hosel.

5. A golf club head comprising a face, a sole, a back, and a hosel wherein a flat, triangular torsion stabilizing surface is raised from the surface of said sole such that each of the three sides of said triangular torsion stabilizing surface is raised, the base of said triangular torsion stabilizing surface is located toward said back and the vertex of said triangular torsion stabilizing surface is located toward said face.

6. The golf club head of claim 5 wherein said golf club head is a wood type golf club head.

7. The golf club head of claim 6 wherein said vertex of said triangular torsion stabilizing surface is blunted.

8. The golf club head of claim 6 wherein said vertex of said flat torsion stabilizing surface is located at about the center of said sole toward said face.

9. The golf club head of claim 6 wherein the leading edge of said sole is angled down and away from said face.

10. The golf club head of claim 6 wherein the loft angle of said face is between about 18 and 24 degrees.

11. The golf club head of claim 6 wherein the weight of said wood type golf club head is distributed disproportionately toward said sole.

12. The golf club head of claim 6 wherein said hosel is offset.

13. A golf club comprising the golf club head of claim 6; and a shaft connected to said golf club head.

14. The golf club of claim 13, wherein said shaft is shorter than a conventional fairway wood.

15. The golf club of claim 14 wherein said shaft is between about 36 inches and 41 inches long.

16. The golf club of claim 13 wherein the diameter of said shaft is between about 0.340 and 0.365 inches at the hosel.

17. A golf club head comprising a face, a sole, a back, and a hosel wherein a flat, triangular torsion stabilizing surface is raised from the surface of said sole such that the base of said triangular torsion stabilizing surface is located toward said back and the vertex of said triangular torsion stabilizing surface is located toward said face; and wherein the torsion stabilizing surface is raised a substantially equal amount above the sole around its periphery.

18. The golf club head of claim 17 wherein said golf club head is a wood type golf club head.

19. The golf club head of claim 18 wherein said vertex of said triangular torsion stabilizing surface is blunted.

20. The golf club head of claim 18 wherein said vertex of said flat torsion stabilizing surface is located at about the center of said sole toward said face.

21. The golf club head of claim 18 wherein the leading edge of said sole is angled down and away from said face.

22. The golf club head of claim 18 wherein the loft angle of said face is between about 18 and 24 degrees.

23. The golf club head of claim 18 wherein the weight of said wood type golf club head is distributed disproportionately toward said sole.

24. The golf club head of claim 18 wherein said hosel is offset.

25. A golf club comprising the golf club head of claim 18; and a shaft connected to said golf club head.

26. The golf club of claim 25, wherein said shaft is shorter than a conventional fairway wood.

27. The golf club of claim 26 wherein said shaft is between about 36 inches and 41 inches long.

28. The golf club of claim 25 wherein the diameter of said shaft is between about 0.340 inches at the hosel.

* * * * *

UNITED STATES PATENT AND TRADEMARK OFFICE

CERTIFICATE OF CORRECTION

PATENT NO. : 6,863,624 B1
DATED : March 8, 2005
INVENTOR(S) : Peter S. Kessler

It is certified that error appears in the above-identified patent and that said Letters Patent is hereby corrected as shown below:

Column 6,
Line 59, after "0.340" insert -- and 0.365 --.

Signed and Sealed this

Seventh Day of June, 2005

JON W. DUDAS
*Director of the United States Patent and Trademark Office*